United States Patent [19]

Wilson

[11] 4,025,280

[45] May 24, 1977

[54] LAMP BURNING VAPORIZABLE LIQUID FUEL

[75] Inventor: Leslie Peter Stuart Wilson, Nassau, Bahamas

[73] Assignee: Shelton Properties, Limited, Dublin, Ireland

[22] Filed: Apr. 15, 1974

[21] Appl. No.: 460,873

[30] Foreign Application Priority Data

| | | |
|---|---|---|
| Apr. 17, 1973 | United Kingdom | 18514/73 |
| May 30, 1973 | United Kingdom | 25783/73 |
| June 22, 1973 | United Kingdom | 29803/73 |
| June 22, 1973 | United Kingdom | 29837/73 |

[52] U.S. Cl. ..... 431/1; 431/311

[51] Int. Cl.[2] ..... F23C 3/02; F23D 3/04

[58] Field of Search ..... 431/1, 310, 311

[56] References Cited

UNITED STATES PATENTS

| | | | |
|---|---|---|---|
| 733,012 | 7/1903 | Compton | 431/311 |
| 1,961,629 | 6/1934 | Bolser | 431/310 |
| 2,135,826 | 11/1938 | Marischal | 431/1 |
| 2,504,584 | 4/1950 | Ramos | 431/325 |
| 2,758,460 | 8/1956 | Ciano | 431/298 |
| 2,774,235 | 12/1956 | Ruetz | 431/325 |
| 2,912,742 | 11/1959 | Choate | 431/325 |
| 2,963,891 | 12/1960 | Brueninghaus | 431/1 |
| 3,307,611 | 3/1967 | Brown | 431/310 |

FOREIGN PATENTS OR APPLICATIONS

| | | | |
|---|---|---|---|
| 212,421 | 12/1957 | Australia | 431/1 |
| 572,947 | 10/1945 | United Kingdom | 431/325 |

*Primary Examiner*—Carroll B. Dority, Jr.
*Attorney, Agent, or Firm*—Edward F. Connors

[57] ABSTRACT

A lamp burning a vaporizable oil produces both a steady light and a regularly recurring bright flash. The lamp has a non-combustible wick in a cooled metal tubular wick holder, the upper part of the wick holder being surrounded by an open-topped combustion chamber which extends inwardly towards a pilot flame on the wick. Heating of the combustion chamber induces air flow causing an explosive mixture to form in the chamber; this is ignited by the pilot flame to give a bright flash.

2 Claims, 3 Drawing Figures

LAMP BURNING VAPORIZABLE LIQUID FUEL

BACKGROUND OF THE INVENTION

1. Field of the Invention

This invention relates to lamps which burn a vaporisable liquid fuel such as for example paraffin oil.

2. Prior Art

Paraffin oil lamps, such as are used to mark road obstructions or as navigation lights on boats and small ships, normally emit a steady or substantially steady light which is produced within the lamp by a flame burning oil fed by a wick from a fuel tank. Despite a fairly high rate of fuel consumption, which commonly requires that lamps should have attention every day, the light emission is not very great and it has been proposed in the past to improve the effectiveness of such lamps as warning lamps by making the flame flicker or flash rather than give a steady light. In particular it has been proposed to have the wick in a wick holder which is located centrally within a shroud, the shroud having holes for admitting air to the space between the shroud and wick holder below the level of the flame. By suitable dimensioning of the hole apertures to restrict the supply of air, such a lamp will produce a flickering flame. The rise and fall in intensity of the flame improves the effectiveness of the lamp as a warning lamp.

SUMMARY OF THE INVENTION

It is an object of the present invention to provide an improved form of liquid fuel lamp in which the flame normally burns at a very low level as a pilot flame but in which intermittently, for example once a second, an explosive mixture of combustible gases is ignited by the pilot flame to produce a very much larger and brighter flame for a short duration of time.

According to this invention, a lamp for burning a vaporisable liquid fuel comprises a wick in a tubular wick holder, the wick extending downwardly from the bottom of the holder into a fuel reservoir, and a structure forming a combustion chamber around at least the upper part of the wick holder, the chamber structure having at least one air inlet aperture and being closed around the wick holder intermediate the ends of the chamber structure or at its lower end to form an open-topped combustion chamber around the upper part of the wick holder and the chamber structure having a portion extending inwardly towards or lying close to the wick above the top of the wick holder tube.

With this construction, the wick dips into the paraffin or other liquid fuel which is carried up the wick to be vaporised and a flame can therefore burn at the top end of the wick. This flame is made a small flame, constituting a pilot flame, by suitable adjustment of the amount of wick exposed in the known way. However, with the arrangement of the present invention in which the chamber structure extends inwardly towards the wick above the wick holder tube or in which the wick is situated near one part of the chamber structure and in which the air is admitted above the bottom of the chamber at a point remote from the wick, the heavier fuel oil vapour tends to sink downwardly in the region of the wick holder, which region may be cooler because of the liquid fuel in the wick within the wick holder. This fuel vapour circulates in the chamber mixing with the air entering the air inlet aperture in the chamber. It is believed that this circulation is induced by the heating of that part of the chamber structure which is close to the pilot flame. A combustible mixture is formed which eventually is ignited by the flame at the top of the wick. This circulatory motion of the vapour in the shroud normally builds up within a minute or so after the lamp has first been lit, when steady state conditions have been reached. When the mixture reaches the top of the chamber and is ignited by the pilot flame, it forms a large flame giving a bright flash. The combustion may set in very rapidly giving a distinctively audible explosive sound. The explosive combustion rapidly terminates. The combustion chamber therefore is now substantially filled with burnt combustion gases and the flame therefore now burns as a steady small flame forming the required pilot light. Circulation of the fuel vapour re-starts and eventually explosive combustion again occurs giving another bright flash. This cyclic operation continues. The bright flame during the explosive combustion is far larger than the pilot flame and provides a bright light although only for a very short duration. The lamp thus gives a flashing light in addition to an approximately steady light. This provides a distinctive warning signal which is far more readily visible from a distance and is better in attracting attention than the steady flame of a conventional oil fuel lamp. For marking road obstructions, a number of lamps are required but lamps flashing out of synchronism do not clearly delineate an object. By making use of the above-described lamp having a steady light as well as giving flashes, the conspicuity of a flashing light is combined with the delineation effect of a steady light. A further advantage of the lamp of the present invention is that the fuel consumption can be made very much smaller than with a conventional lamp providing a steady flame. It is thus readily possible to provide portable warning lights such as might be used for marking obstructions on roads or the like which can operate for many days with one filling of fuel.

In the constructions described above, the open-topped combustion chamber around the wick and wick holder forms a structure inducing airflow, in a manner somewhat analogous to a conventional chimney glass on an oil lamp, and hence promote efficient combustion of the fuel.

DESCRIPTION OF THE PREFERRED EMBODIMENTS

Figure 1:
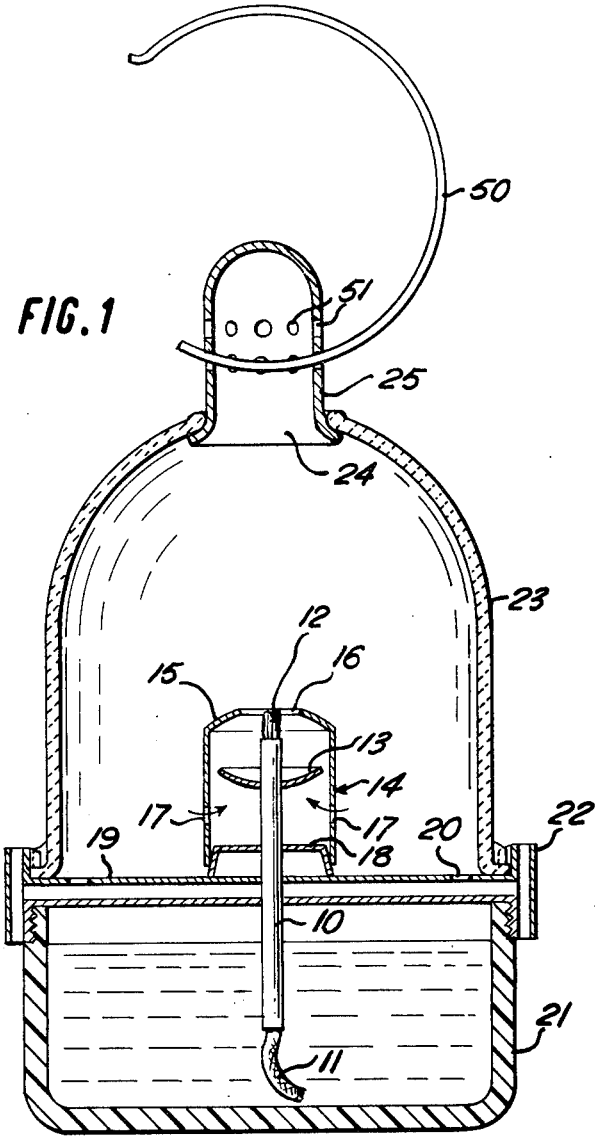
FIG. 1 is a vertical section through one construction of burner and lantern assembly forming a paraffin oil burning lamp.

Referring to FIG. 1, the burner has a cylindrical metal tube 10 forming a wick holder with a glass fibre wick 11 secured with the required length 12 of wick exposed above the top of the tube. Secured around the tube 10 is a dish-shaped metal disc 13 which extends outwardly nearly to a cylindrical wall of a metal combustion chamber structure 14. This structure 14 is of generally cylindrical form with a domed top 15 leaving a central aperture 16. The top of the dome is just above the level of the top of the pilot flame. The wick 11 has only a very short length exposed above the end of the wick holder tube.

Below the disc 13 are a number of air inlet apertures 17 in the wall of the structure 14. Below these apertures is a bottom closure plate 18. This plate 18 has a downwardly extending flange and seats on a plate 19 having apertures 20. Air entering through apertures 20 can pass into the structure 14 through apertures 17 and through the peripheral space around the disc 13 into the open-topped chamber formed by the upper part of the structure 14.

The plate 19 is spaced above the top surface of a fuel container 21, the wick holder and wick extending into this container 21, with the lower end of the wick in the fuel. The plate 19 and the fuel container are secured together by a corrugated peripheral ring 22 permitting air entry into the region between the plates, the ring forming a windshield. A moulded transparent lantern 23, which may be coloured, is secured in an upstanding flange on the plate 19, the lantern having an opening 24 at the top to permit exit of combustion gases. A rainshield 25 with a carrying handle 50 is provided over this latern, the rainshield having a flange fitting under the peripheral edge of the opening 24 and being secured in position by the carrying handle 50 passing through two of the outer apertures 51.

The ring 22 forming the windshield serves also to hold the top and bottom parts of the lamp structure together, and acts as a mounting holding and locating the burner. It is preferably made of metal and serves as a radiator to remove surplus heat taken from the wick and wick holder tube by conduction through the metal structure of the lamp. It also serves to prevent rain entering the lamp. By corrugating or fluting this ring, it can give major structural strength to the lamp assembly.

In operation, the burner is lit and normally has a small pilot flame. Fuel evaporates at the exposed top of the wick and fuel vapour condenses around the cool wick holder. The condensed vapour falls downwardly in the open-topped chamber and mixes with incoming air to form an explosive mixture which circulates to the pilot flame and causes a bright flash. The circulation is induced by the heat in the chamber structure. The chamber structure 14 forms a chimney inducing airflow and so promoting efficient combustion.

Figure 2:
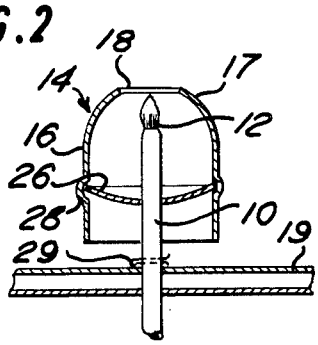
FIG. 2 is a section through another construction of burner.
Figure 3:
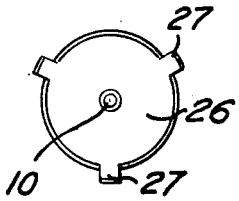
FIG. 3 is a plan view of a part of the burner of FIG. 2.

FIGS. 2 and 3 illustrate a modified construction of burner. The same references are employed as in FIG. 1 to indicate corresponding components. In FIGS. 2 and 3 the disc 13 is replaced by a dish-shaped disc 26 having three outwardly extending lugs 27 which fit loosely in a peripheral recess 28 pressed out in the metal structure 14. The wick holder is slightly eccentric in the disc; typically it is 1 mm off-centre of a 10 mm diameter disc. The wick is secured by a pin 29 which passes through the wick 11 and wick holder 10 and sits on the plate 19 to to locate the combustion chamber structure above the plate 19. Air thus enters the bottom of this structure and passes around the periphery of disc 26 into the combustion chamber.

I claim:

1. A lamp for burning a vaporizable liquid fuel with a steady continuous pilot light that is constantly visible along with periodical flashes of brighter light comprising a tubular wick holder having a lower end portion and an upper end portion, a wick in said wick holder, a fuel reservoir below the lower end portion of the wick holder, the wick extending downwardly from the lower end portion of the wick holder into said fuel reservoir, a structure forming a chamber around at least the upper end portion of the wick holder, the chamber structure having an upper end portion and a lower end portion and having at least one constantly open air inlet aperture into the chamber below the upper end portion thereof, a disc fixedly circumposed on the wick holder above the said air inlet aperture, said disc extending from the wick holder to a position slightly spaced from the inner walls of the chamber structure, said chamber structure having its lower end portion closed around the wick holder below the air inlet aperture and the disc and having the end of its upper end portion inturned towards the wick holder to provide a partial top closure cap with the inturned end extending most of the way across and covering the majority of the chamber, said wick having an upper burning end located above the end of the upper end portion of the wick holder, said top closure cap being located adjacent the upper burning end of the wick and the end of the upper end portion of the wick holder, said top closure cap being provided above the upper burning end of the wick and the end of the upper end portion of the wick holder with an opening that lies in a single plane, a lantern mounted on the fuel reservoir and spacedly surrounding the chamber structure and extending thereabove and above the upper end portion of the wick holder and the holder burning end of the wick therein, means carried by the lantern for admitting air constantly into the region outside of the chamber structure to flow over the top closure cap of the chamber structure and supply air for the wick which burns normally in a pilot flame above the top of the chamber structure using the air supplied from outside the chamber structure, the pilot flame being visible constantly through the lantern, and the pilot flame heating the adjacent part of the chamber structure below the top closure cap so as to cause evaporation of fuel from the exposed wick within said chamber to form a vapor which accumulates in the chamber onto the disc with air constantly entering said chamber through the air inlet aperture from the air admission means carried by the lantern until the mixture is ignited by the pilot flame and ejected from the chamber through the opening in the top closure cap to produce periodically a short duration enlarged flame of brighter light than the pilot flame.

2. The invention of claim 1, wherein said disc is dish-shaped.

* * * * *